US010626867B2

(12) United States Patent
Ozu et al.

(10) Patent No.: US 10,626,867 B2
(45) Date of Patent: Apr. 21, 2020

(54) ELECTRIC COMPRESSOR AND REFRIGERATION DEVICE HAVING SAME

(71) Applicant: GUANGDONG MEIZHI COMPRESSOR CO., LTD., Foshan (CN)

(72) Inventors: Masao Ozu, Foshan (CN); Jijiang Yu, Foshan (CN); Cheng Zhang, Foshan (CN); Hong Guo, Foshan (CN); Xingbiao Zhou, Foshan (CN); Liang Zhong, Foshan (CN); Lili Yan, Foshan (CN); Ling Wang, Foshan (CN)

(73) Assignee: GUANGDONG MEIZHI COMPRESSOR CO., LTD., Foshan (CN)

( * ) Notice: Subject to any disclaimer, the term of this patent is extended or adjusted under 35 U.S.C. 154(b) by 332 days.

(21) Appl. No.: 15/315,981

(22) PCT Filed: Feb. 2, 2015

(86) PCT No.: PCT/CN2015/072123
§ 371 (c)(1),
(2) Date: Dec. 2, 2016

(87) PCT Pub. No.: WO2016/115755
PCT Pub. Date: Jul. 28, 2016

(65) Prior Publication Data

US 2017/0130717 A1 May 11, 2017

(30) Foreign Application Priority Data

Jan. 21, 2015 (CN) ..... 2015 1 0031793
Jan. 21, 2015 (CN) ..... 2015 2 0043529 U

(51) Int. Cl.
*F04C 18/356* (2006.01)
*F04C 29/00* (2006.01)
(Continued)

(52) U.S. Cl.
CPC ..... *F04C 18/356* (2013.01); *F04C 18/3564* (2013.01); *F04C 23/008* (2013.01);
(Continued)

(58) Field of Classification Search
CPC .. F04C 18/356; F04C 18/3564; F04C 23/008; F04C 23/02; F04C 29/0021;
(Continued)

(56) References Cited

U.S. PATENT DOCUMENTS 2,983,154 A * 5/1961 Neukirch ..... F16H 29/04 74/117
6,095,923 A * 8/2000 Kageyama ..... F16C 3/02 464/24

(Continued)

FOREIGN PATENT DOCUMENTS

CN 1469047 A 1/2004
CN 103368357 A 10/2013

(Continued)

OTHER PUBLICATIONS

English Translation of JP H08-1282324 (Toru) obtained on Dec. 12, 2018 (Year: 2018).*

(Continued)

*Primary Examiner* — Connor J Tremarche
(74) *Attorney, Agent, or Firm* — Scully, Scott, Murphy & Presser, P.C.

(57) ABSTRACT

An electric compressor and a refrigeration device having the same are provided. The electric compressor includes: an electric motor having a stator and a rotor; a compressing mechanism having an eccentric shaft rotatably and slidably connected to the rotor and defining a compressing chamber therein, the compressing chamber being configured to perform a compression by the eccentric shaft; and a torque damping device configured to connect the rotor with the
(Continued)

eccentric shaft, in which during the compression of the compressing chamber, a difference between a rotation angle of the eccentric shaft and a rotation angle of the rotor is a phase angle which is increased and decreased.

8 Claims, 10 Drawing Sheets

(51) Int. Cl.

| | |
|---|---|
| ***F04C 23/02*** | (2006.01) |
| ***F25B 31/02*** | (2006.01) |
| ***F04C 29/02*** | (2006.01) |
| ***F04C 23/00*** | (2006.01) |
| *F04C 2/356* | (2006.01) |
| *F04C 11/00* | (2006.01) |
| *F04C 15/00* | (2006.01) |

(52) U.S. Cl.
CPC ..... *F04C 23/02* (2013.01); *F04C 29/005* (2013.01); *F04C 29/0021* (2013.01); *F04C 29/023* (2013.01); *F25B 31/026* (2013.01); *F04C 2/356* (2013.01); *F04C 11/008* (2013.01); *F04C 15/0042* (2013.01); *F04C 2270/125* (2013.01); *F25B 2500/06* (2013.01); *F25B 2500/12* (2013.01); *F25B 2500/13* (2013.01); *F25B 2500/26* (2013.01); *F25B 2500/27* (2013.01)

(58) Field of Classification Search
CPC ..... F04C 29/005; F04C 29/023; F04C 2/356; F04C 11/008; F04C 15/042; F04C 2270/125; F04C 15/0042; F25B 31/026; F25B 2500/06; F25B 2500/12; F25B 2500/13; F25B 2500/26; F25B 2500/27
USPC ..... 417/223
See application file for complete search history.

(56) References Cited

U.S. PATENT DOCUMENTS

| | | | | |
|---|---|---|---|---|
| 6,712,174 | B1 * | 3/2004 | Bohner | B62D 5/006 180/402 |
| 2007/0060400 | A1 * | 3/2007 | Kobelev | F16F 1/16 464/160 |
| 2007/0245991 | A1 * | 10/2007 | Weber | F01L 1/3442 123/90.17 |
| 2009/0092506 | A1 | 4/2009 | Haller | |
| 2011/0150683 | A1 * | 6/2011 | Lee | F04C 18/086 418/5 |

FOREIGN PATENT DOCUMENTS

| | | | |
|---|---|---|---|
| CN | 103742411 | A | 4/2014 |
| CN | 104564682 | A | 4/2015 |
| CN | 204783663 | U | 11/2015 |
| GB | 903197 | A | 8/1962 |
| JP | H08-182234 | * | 7/1996 |
| JP | H08182234 | A | 7/1996 |
| JP | 2552562 | B2 | 11/1996 |
| JP | H0988822 | A | 3/1997 |
| JP | 2004003406 | A | 1/2004 |
| JP | 2012200131 | A | 10/2012 |

OTHER PUBLICATIONS

International Search Report issued in PCT/CN2015/072123 dated Oct. 29, 2015 (2 pages).
Written Opinion of the International Searching Authority issued in PCT/CN2015/072123 dated Oct. 29, 2015 (4 pages).
Office Action issued in corresponding Japanese Application No. 2016-521608, dated Aug. 22, 2017 and english translation (6 pages).
Office Action issued in corresponding Chinese Application No. 201510053963.2, dated Apr. 6, 2016 (19 pages).
Office Action issued in corresponding Japanese Application No. 2016-521608, dated Apr. 11, 2017 (9 pages).

* cited by examiner

ELECTRIC COMPRESSOR AND REFRIGERATION DEVICE HAVING SAME

RELATED APPLICATIONS

This U.S. application claims priority under 35 U.S.C 371 to, and is a U.S. National Phase application of, International Patent Application No. PCT/CN2015/072123, filed on Feb. 2, 2015, which claims the benefit of prior Chinese Application Numbers 201510031793.8 filed on Jan. 21, 2015, and 201520043529.1 filed on Jan. 21, 2015, The entire contents of the above patent applications are incorporated by reference as part of the disclosure of this U.S. application.

FIELD

The present disclosure relates to a refrigeration field, more particularly to an electric compressor and a refrigeration device having the same.

BACKGROUND

In order to realize the objective of reducing a rotary vibration during operation, a technology of controlling a torque of an electric motor caused by a waveform synthesis of a direct current (DC) frequency conversion electric motor is widely used in an air conditioner provided with a rotary compressor or a refrigerator provided with a reciprocating compressor. The technology of controlling the torque of the electric motor together with a rotary position of a rotor detects a variation of a shaft and performs the waveform synthesis of a frequency converter, so that the torque of the electric motor is similar to the eccentric shaft torque (called as shaft torque in following), and an angular velocity of the rotating rotor is stable.

The rotary vibration of the compressor may be reduced due to the technology of controlling. However the technology of controlling the torque of the electric motor cannot be used in an alternating current electric motor or an alternating current (AC) frequency conversion electric motor, an efficiency of the electric motor may be reduced due to the waveform synthesis. In addition, because of an increased cost and a technique difficulty, it is presumed that a worldwide penetration of the compressor using the technology of controlling the torque of the electric motor is below 5%.

In the related art, a compressing mechanism of the rotation compressor further has a spring to mitigate the rotation vibration, which mitigates a vibration transmission to a casing. In such method, it is difficult to connect the compressing mechanism to a suction tube and to align a stator with the rotor. In the related art, a disk-shaped weight is further provided, which increases an inertia three of the rotor and decreases the variation of the angular velocity of the eccentric shaft. The method requires a disk with a big outer diameter and a heavy weight, which is not realized, as a gap with respect to a coil of the electric motor cannot be ensured.

SUMMARY

Embodiments of the present disclosure seek to solve at least one of the problems existing in the related art to at least some extent.

Accordingly, an electric compressor is provided by the present disclosure, so that an angular velocity of a rotor is stable.

A refrigeration device having the electric compressor described above is provided by the present disclosure.

The electric compressor according to embodiments of the present disclosure includes: an electric motor having a stator and a rotor; a compressing mechanism having an eccentric shaft rotatably and slidably connected to the rotor and defining a compressing chamber therein, the compressing chamber being configured to perform a compression by the eccentric shaft; and a torque damping device configured to connect the rotor with the eccentric shaft, in which during the compression of the compressing chamber, a difference between a rotation angle of the eccentric shaft and a rotation angle of the rotor is a phase angle which is increased and decreased.

With the electric compressor according to embodiments of the present disclosure, by providing the torque damping device, the angular velocity of the rotor is stable. The electric compressor has following advantages: 1) noise reduction; 2) starting performance improvement of the compressor; 3) reduction of damages caused by a liquid compression; 4) reduction of operation stops caused by a low voltage.

In some embodiments of the present disclosure, the torque damping device includes one of a torsion bar spring, a helical torsion coil spring and a spiral spring which have actuation ends connected to the eccentric shaft and the rotor respectively.

In some embodiments of the present disclosure, one of the actuation ends of the torsion bar spring is mounted in the eccentric shaft.

In some embodiments of the present disclosure, a part of the actuation ends of the torsion bar spring is slidably fitted with an inner diameter of the rotor or a shaft end portion of the eccentric shaft.

In some embodiments of the present disclosure, one of the actuation ends of the torsion bar spring is provided with a fixing shaft fixed at an inner diameter of the rotor.

In some embodiments of the present disclosure, one of the actuation ends of the torsion bar spring is provided with a torque rod perpendicularly intersected with a shaft core of the torsion bar spring.

In some embodiments of the present disclosure, one of the actuation ends of the helical torsion coil spring or the spiral spring is mounted at a shaft end portion of the eccentric shaft.

In some embodiments of the present disclosure, one of the the actuation ends of the torsion bar spring, the helical torsion coil spring or the spiral spring is mounted at an end ring or an iron core plate further disposed in the rotor.

In some embodiments of the present disclosure, the torsion bar spring, the helical torsion coil spring or the spiral spring is configured as a non-liner spring having a spring constant which increases with an increase of the phase angle.

In some embodiments of the present disclosure, the compressing mechanism is provided with a bearing configured to support the eccentric shaft in a slidable fitting manner, and the actuation end of the torsion bar spring mounted in the eccentric shaft is positioned in a range of a slidably fitted supporting of the eccentric shaft and the bearing.

The refrigeration device according to embodiments of the present disclosure includes the electric compressor according to embodiments of the present disclosure described above.

By being provided with the electric compressor described above, the refrigeration device according to embodiments of the present disclosure thus has following advantages: 1) noise reduction; 2) starting performance improvement of the compressor; 3) reduction of damages caused by a liquid compression; 4) reduction of operation stops caused by a low voltage.

Figure 1:
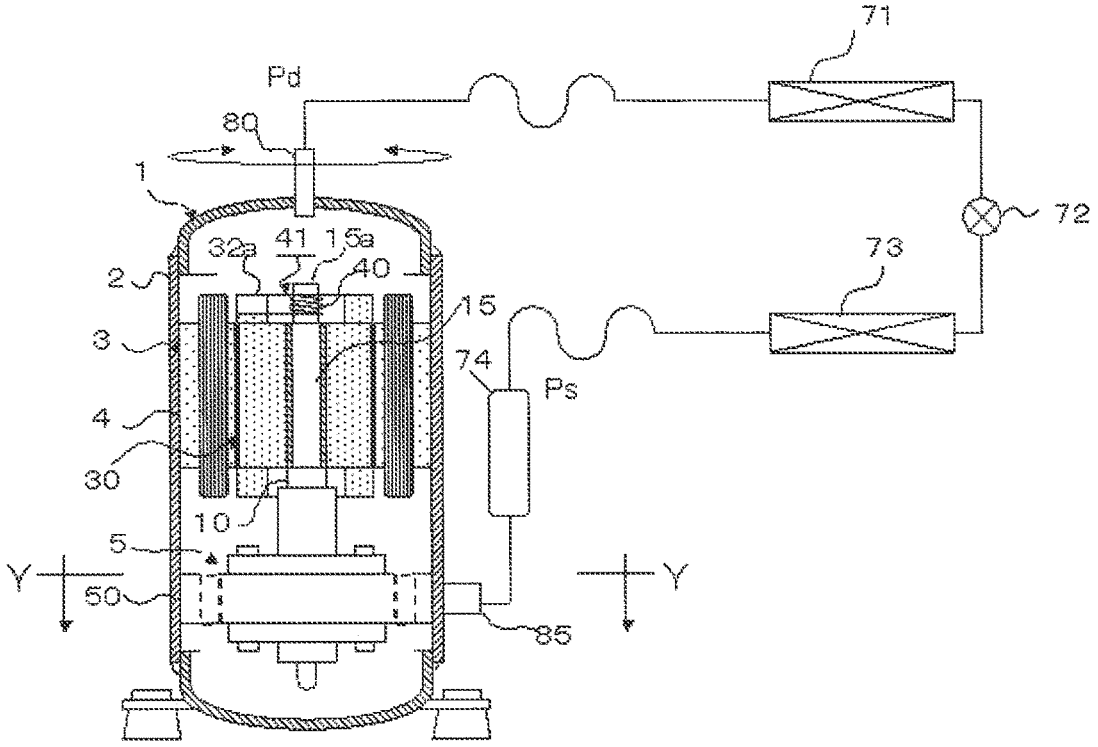
FIG. 1 is related to embodiment 1 of the present disclosure, showing a longitudinal sectional view of a rotation compressor connected to a refrigeration system.

REFERENCE NUMERALS rotation compressor 1, reciprocating compressor 101, casing 2 (102), compressing mechanism 5 (105), electric motor 3, stator 4, rotor 30, end ring groove 32*a*, iron core center tube 34, rotor iron core 31, cylinder 50, compressing chamber 51 (126), low-pressure chamber 51*a*, high-pressure chamber 51*b*, eccentric shaft 10 (110), main shaft 11, sliding shaft 15, spring mounting shaft 15*a*, shaft end groove 15*b*, eccentric portion 13, piston 52 (128), sliding sheet 53, outlet 55*b*, torque damping device 41, helical torsion coil spring (coil spring) 40, coil portion 40*a*, shaft-side actuation end 40*b*, rotor-side actuation end 40*c*, thrust ring 18 (18*a*, 18*b*), frame 120, cylinder block 125, bearing 122, valve cover 162, quakeproof spring 108, silencer 160, torsion bar spring 47, torque bar 44, spring pin 19, shaft hole 14, torsion shaft 47*a*, actuation end A48, actuation end 1349, actuation end C45, main bearing 55, cross hole 14*a*, main shaft end hole 11*b*, end ring 32, end plate 37, rivet 32*b*, hook 31*b*, reservoir 74, suction tube 85 (150), air discharging tube 80 (165), outdoor heat exchanger 71, expansion valve (or capillary) 72, indoor heat exchanger 73.

DETAILED DESCRIPTION

Reference will be made in detail to embodiments of the present disclosure. The embodiments described herein with reference to drawings are explanatory, illustrative, and used to generally understand the present disclosure. The embodiments shall not be construed to limit the present disclosure.

In the specification, it is to be understood that terms such as "central," "longitudinal," "lateral," "length," "width," "thickness," "upper," "lower," "front," "rear," "left," "right," "vertical," "horizontal," "top," "bottom," "inner," "outer," "clockwise," and "counterclockwise" as well as derivative thereof (e.g., "horizontally", "downwardly", "upwardly", etc.) should be construed to refer to the orientation as then described or as shown in the drawings under discussion. These relative terms are for convenience of description and do not require that the present disclosure be constructed or operated in a particular orientation.

In addition, terms such as "first" and "second" are used herein for purposes of description and are not intended to indicate or imply relative importance or significance or to imply the number of indicated technical features. Thus, the feature defined with "first" and "second" may comprise one or more of this feature. In the description of the present disclosure, unless specified otherwise, "a plurality of" means at least two, e.g., two, three and so on.

In the description of the present disclosure, unless specified or limited otherwise, it should be noted that, terms "mounted," "connected" "coupled" and "fastened" may be understood broadly, such as permanent connection or detachable connection, electronic connection or mechanical connection, direct connection or indirect connection via intermediary, inner communication or inter reaction between two elements. These having ordinary skills in the art should understand the specific meanings in the present disclosure according to specific situations.

With reference to FIG. 1 to FIG. 18, an electric compressor according to embodiments of the present disclosure will be described in the following. The electric compressor may be a rotation compressor, a reciprocating compressor or a scroll compressor. The electric compressor may be used in devices such as a refrigerator, an air conditioner and a water heater.

The electric compressor according to embodiments of the present disclosure includes: an electric motor 3, a compressing mechanism and a torque damping device. Specifically, the electric motor 3 has a stator 4 and a rotor 30. The compressing mechanism has an eccentric shaft rotatably and slidably connected to the rotor 30 and defines a compressing chamber therein. The compressing chamber is configured to perform a compression by the eccentric shaft. The torque damping device is configured to connect the rotor 30 with the eccentric shaft. During the compression of the compressing chamber, a difference between a rotation angle θ1 of the eccentric shaft and a rotation angle θ2 of the rotor is a phase angle θ3, and the phase angle θ3 is increased and decreased.

With the electric compressor according to embodiments of the present disclosure, by providing the torque damping device, the angular velocity of the rotor is stable. The electric compressor has following advantages: 1) noise reduction; 2) starting performance improvement of the compressor; 3) reduction of damages caused by a liquid compression; 4) reduction of operation stops caused by a low voltage.

In embodiments of the present disclosure, the torque damping device includes one of a torsion bar spring 47, a helical torsion coil spring 40 and a spiral spring which have actuation ends connected to the eccentric shaft and the rotor respectively. That is, the torque damping device includes the torsion bar spring 47, the helical torsion coil spring 40 or the spiral spring, and the actuation ends of the torsion bar spring 47, the helical torsion coil spring 40 or the spiral spring are connected to the eccentric shaft and the rotor respectively.

Specifically, one of the actuation ends of the torsion bar spring 47 is mounted in the eccentric shaft.

Specifically, a part of the actuation ends of the torsion bar spring 47 is slidably fitted with an inner diameter of the rotor or a shaft end portion of the eccentric shaft.

In some embodiments of the present disclosure, one of the actuation ends of the torsion bar spring 47 is provided with a fixing shaft fixed at an inner diameter of the rotor, e.g., the actuation end of the torsion bar spring 47 may be interference-fitted with an inner diameter of a rotor iron core 31, in which case the torsion bar spring 47 defines the fixing shaft, so that connecting parts between the torsion bar spring 47 and the rotor may be reduced, thus facilitating an assembly of the torsion bar spring 47.

Specifically, one of the actuation ends of the torsion bar spring 47 is provided with a torque rod 44 perpendicularly intersected with a shaft core of the torsion bar spring 47, so that the actuation end of the torsion bar spring 47 may be connected to the rotor 30 via the torque rod 44.

Specifically, one of the actuation ends of the helical torsion coil spring 40 or the spiral spring is mounted at a shaft end portion of the eccentric shaft.

Specifically, one of the the actuation ends of the torsion bar spring 47, the helical torsion coil spring 40 or the spiral spring is mounted at an end ring or an iron core plate further disposed in the rotor.

Specifically, the torsion bar spring 47, the helical torsion coil spring 40 or the spiral spring is configured as a non-liner spring having a spring constant which increases with an increase of the phase angle θ3.

Specifically, the compressing mechanism is provided with a bearing configured to support the eccentric shaft in a slidable fitting manner, and the actuation end of the torsion bar spring 47 mounted in the eccentric shaft is positioned in a range of a slidably fitted supporting of the eccentric shaft and the bearing.

A refrigeration device according to embodiments of the present disclosure includes the electric compressor according to embodiments of the present disclosure described above.

By providing the electric compressor described above, the refrigeration device according to embodiments of the present disclosure thus has following advantages: 1) noise reduction; 2) starting performance improvement of the compressor; 3) reduction of damages caused by a liquid compression; 4) reduction of operation stops caused by a low voltage.

With reference to FIG. 1 to FIG. 18, in the following, the electric compressor according to some embodiments of the present disclosure will be described in detail.

Embodiment 1

In embodiment the present disclosure is applied in a single-cylinder rotation compressor with a one-way induction motor. FIG. 1 shows a construction of a rotation compressor 1 and a refrigeration system. The rotation compressor 1 includes a compressing mechanism 5 fixed at an inner diameter of a scaled cylinder casing 2 and an electric motor 3 provided on a top of the compressing mechanism 5. The electric motor 3 includes a stator 4 fixed at the inner diameter of the casing 2 and a rotor 30 fixed on an eccentric shaft 10 of the compressing mechanism 5.

A low-pressure air (pressure Ps) passing through a reservoir 74 and suck to the compressing mechanism 5 from a suction tube 85 is compressed in a compressing chamber 51 of a cylinder 50 (shown in FIG. 2) and discharged into the casing 2. Thus, a pressure of the casing 2 is a high-pressure (Pd). The high-pressure air discharged into the casing 2 flows through an air discharging tube 80, an outdoor heat exchanger 71, an expansion valve (or a capillary) 72, an indoor heat exchanger 73 and the reservoir 74 sequentially.

A feature of the present disclosure is that, a torque damping device 41 is provided at a top of the rotor 30 rotating and sliding around a sliding shaft 15 which forms the eccentric shaft 10. The torque damping device 41 has a helical torsion coil spring 40 (called as coil spring 40 in the following) inserted and fixed in a groove of a spring mounting shaft 15*a*. The coil spring 40 has two actuation ends fixed at the spring mounting shaft 15*a* of the eccentric shaft 10 and an end ring groove 32*a* of the rotor 30 respectively.

Figure 2:
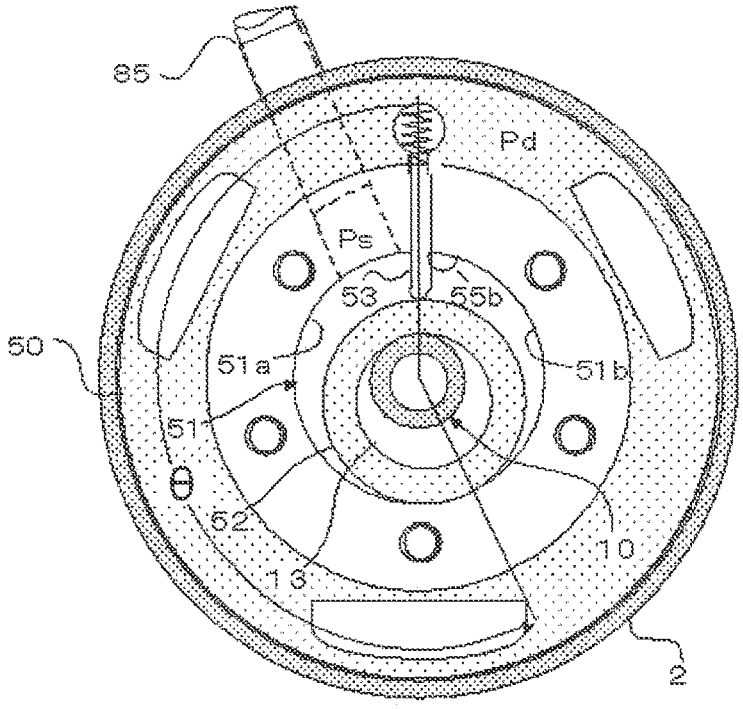
FIG. 2 is related to embodiment 1 of the present disclosure, showing a sectional view of a cylinder illustrating a construction of a compressing chamber and a relationship between a rotation angle of a piston and a suction-compression stroke.

FIG. 2 shows a Y-Y section of FIG. 1, illustrating a principle of air suction and air compression of the compressing chamber 51. Because an eccentric portion 13 of the eccentric shaft 10 rotates counterclockwise, a piston 52 revolves along an inner circumference of the compressing chamber 51. The compressing chamber 51 is divided into two by the largest outer circumference of the piston 52 and a front end of a sliding sheet 53, and usually consists of a low-pressure chamber 51*a* configured to suck the low-pressure air (pressure Ps) and a high-pressure 51*b* configured to compress the low-pressure air into the high-pressure air. A rotation position of the largest outer circumference of the piston 52 may be presented as a counterclockwise angle θ from the sliding sheet 53.

Because of the rotation of the piston 52, after the pressure of the air in the high-pressure chamber 51*b* is increased to the pressure (Pd) of the casing, the air is discharged into the casing 2 from an outlet 55*b*. The air discharging is continuous before the angle θ reaches 360°, and the entire compressing chamber 51 has a low pressure after the angle θ reaches 360°.

A shaft torque (i.e., Tc in FIG. 7) of the eccentric shaft 10 varies repeatedly during per rotation of the eccentric shaft 10. If the shaft torque of the eccentric shaft 10 is large, the angular velocity is decreased. If the shaft torque of the eccentric shaft 10 is small, the angular velocity is increased.

The rotor of the conventional rotation compressor is fixed at the eccentric shaft, so that the angular velocity of the rotor is substantially equivalent to the angular velocity of the eccentric shaft. The variation of the angular velocity of the rotor is a torsional vibration.

Figure 3:
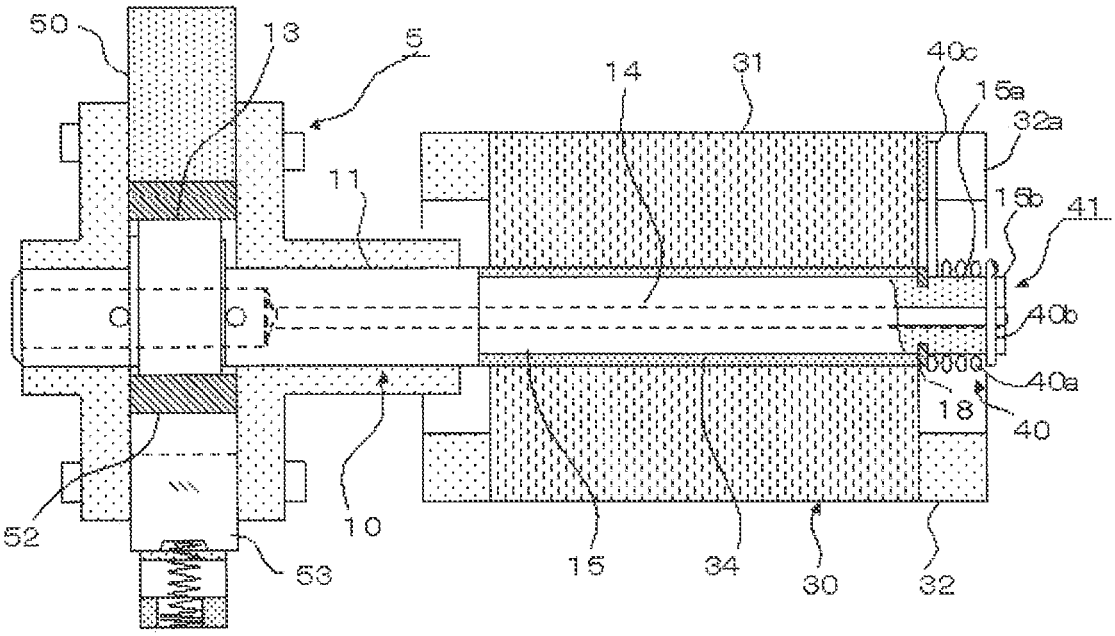
FIG. 3 is related to embodiment 1 of the present disclosure, showing a detailed sectional view of a constitution of a compressing mechanism connected to a rotor.
Figure 4:
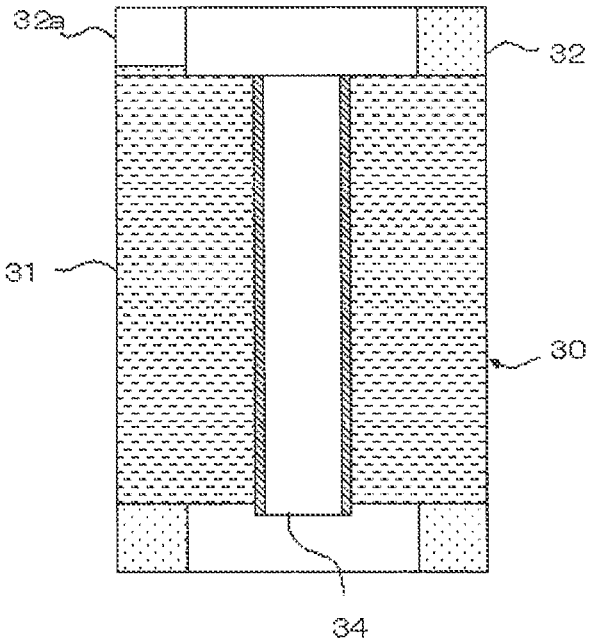
FIG. 4 is related to embodiment 1 of the present disclosure, showing a sectional view of a rotor.
Figure 5:
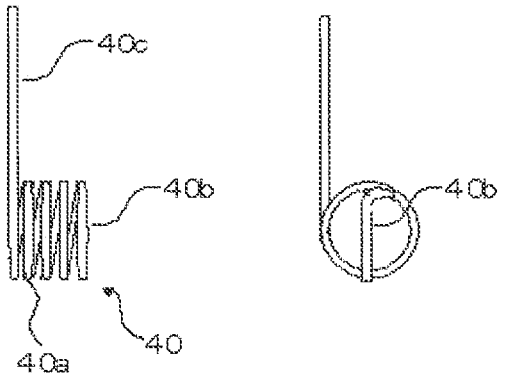
FIG. 5 is related to embodiment 1 of the present disclosure, showing a view of components of a helical torsion coil spring.

FIG. 3 shows the compressing mechanism 5 and the rotor 30 connected to the compressing mechanism 5, FIG. 4 shows a section of the rotor 30 and FIG. 5 shows a view of components of the coil spring 40.

In FIG. 3 and FIG. 4, an iron core center tube 34 fixed at the inner diameter of the rotor 30 is slidably fitted with the sliding shaft 15 which is thinner than a main shaft 11 of the eccentric shaft 10. A coil portion 40*a* of the coil spring 40 is inserted into an outer circumference of the spring mounting shaft 15*a* on the top of the sliding shaft 15. Meanwhile, a shaft-side actuation end 40*b* is inserted in a shaft end groove 15*b*.

One rotor-side actuation end 40*c* is inserted in the end ring groove 32*a*. As a result thereof, the sliding shaft 15 is slidably fitted with the rotor 30 and they are connected by the coil spring 40. The coil spring 40 and a connecting means configured to connect the rotor 30 to the eccentric shaft 10 by the coil spring 40 are collectively called as the torque damping device 41.

Furthermore, an inner diameter of the iron core center tube 34 inserted and fixed in a center hole of the rotor iron core 31 is a little bigger than the outer diameter of the sliding shaft 15, so that a sliding gap for automatic rotation and sliding is provided. Usually, load and sliding speed acting on sliding surfaces of the sliding shaft 15 and the iron core center tube 34 are small if a wear-resistance surface treatment is implemented on the eccentric shaft 10. Thus, the lubrication in the above sliding gap may have a sufficient oil supply due to oil dissolved in the air floating in the casing 2. In case of an abrasion problem, a helical oil groove may further be disposed in a sliding component of one of the sliding shaft 15 and the iron core center tube 34.

A thrust ring 18 fixed in the ring groove of the spring mounting shaft 15*a* may prevent the rotor 30 from falling off from the sliding shaft 15. The thrust ring 18 also may be a C-shaped retaining ring. Furthermore, in order to prevent the coil spring 40 inserted in the shaft end groove 15*b* from falling off, a ring groove may be further formed in the top of the shaft end groove 15*b* and the C-shaped retaining ring may also be mounted in the ring groove.

As shown in FIG. 5, the coil spring 40 consists of the coil portion 40*a* in the center thereof and the shaft-side actuation end 40*b* and the rotor-side actuation end 40*c* at both ends thereof. Two actuation ends may extend or retract with the phase angle, i.e. the difference between the rotary angle of the eccentric shaft 10 and the rotation angle of the rotor 30. Furthermore, there is a gap between the inner diameter of the coil portion 40*a* and the outer diameter of the spring mounting shaft 15*a*.

Figure 6:
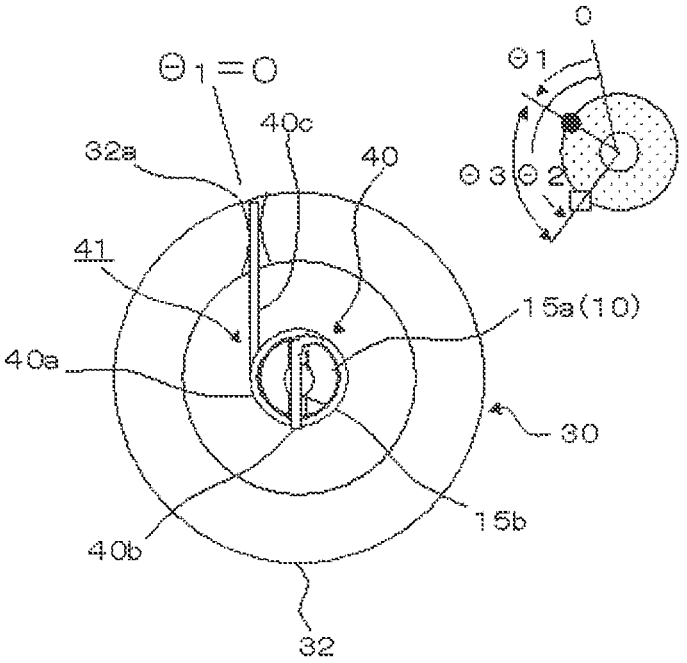
FIG. 6 is related to embodiment 1 of the present disclosure, showing an assembly view of a rotor and a helical torsion coil spring.

FIG. 6 is an assembly view of the shaft-side actuation end 40*b* and the rotor-side actuation end 40*c* mounted in the shaft end groove 15*b* and the end ring groove 32*a* respectively. The shaft-side actuation end 40*b* rotates together with the eccentric shaft 10 and the rotor-side actuation end 40*c* rotates together with the rotor 30. At this time, the rotor 30 usually drives the eccentric shaft 10 to rotate in a counterclockwise direction by the coil spring 40.

The difference between the rotation angle θ1 of the eccentric shaft 10 and the rotation angle θ2 of the rotor 30 in operation is the phase angle θ3. If the shaft torque of the eccentric shaft 10 is represented as Tc, a shaft torque of the rotor 30 is represented as Tr and Tr is larger than Tc during the compressing operation, θ3>0 and θ3 is increased or decreased based on the variation of Tc.

If the shaft torque Tc is increased, the angular velocity of the eccentric shaft 10 is decreased. However, a reduction of the angular velocity of the rotor 30 connected to the coil spring 40 is decreased. Thus, θ3 is increased and the coil spring 40 may store energy. After this, if Tc starts to be decreased, the angular velocity of the eccentric shaft 10 is increased.

During this, the rotor 30 releases the energy stored by the coil spring 40 and drives the eccentric shaft 10, so that θ3 is decreased. Meanwhile, the angular velocity of the eccentric shaft 10 is increased, and thus a delay between the rotation angles can be recovered.

Figure 7:
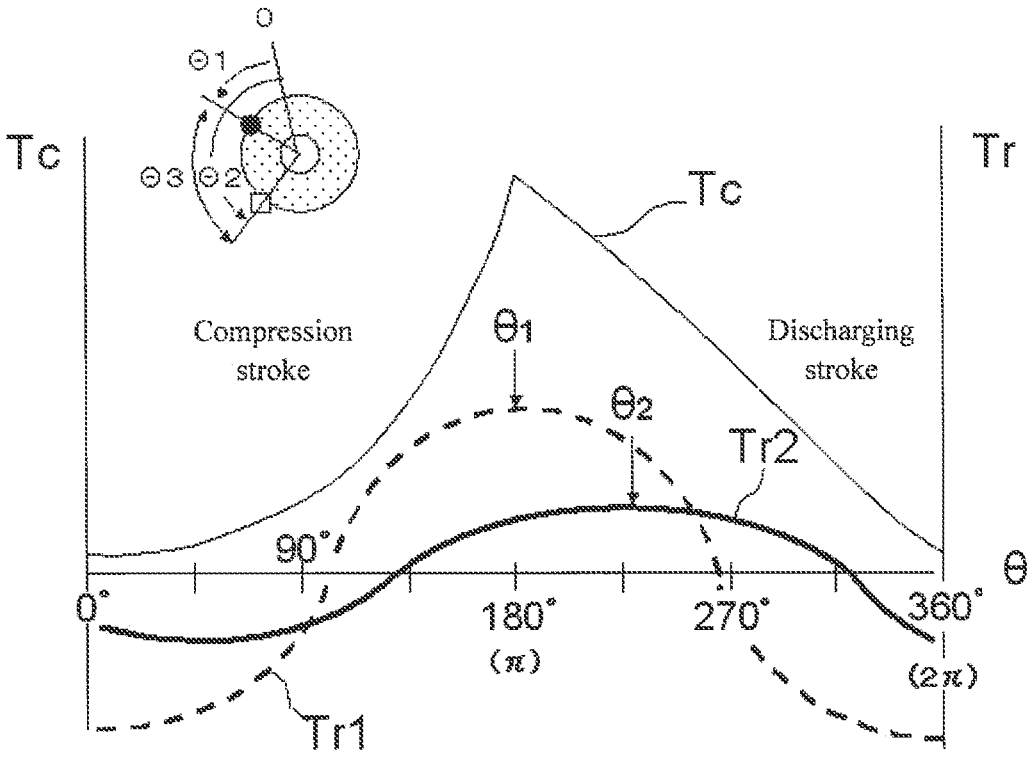
FIG. 7 is related to embodiment 1 of the present disclosure, showing a comparison diagram between the present disclosure and prior technology related to a variation of a torque of an electric motor caused by a shaft torque produced in a compressing chamber.

FIG. 7 shows the above process conceptually. In a traverse axis, the rotation angle θ of the eccentric shaft 10 is shown, which is in a range from 0 degree to 360 degrees (θ is illustrated in FIG. 2). A left longitudinal axis represents the shaft torque Tc of the eccentric shaft and a right longitudinal axis represents the torque Tr of the rotor. In two torque curves, Tr2 (solid line) shows the variation of the torque of the rotor 30 of the present disclosure, and Tr1 (dashed line) shows the variation of the torque of the conventional rotor without the torque damping device.

The shaft torque Tc of the eccentric shaft 10 is increased gradually in the compression stroke which starts from a suction hole being opened by 25 degrees, and reaches a maximum at about 180 degrees. Subsequently, an air discharging stroke is switched to, an air displacement is decreased and reaches a minimum at about 360 degrees. Meanwhile, an air suction reaches a maximum, and the compression stroke is switched to after 25 degrees in a second rotation.

The torque Tr1 of the rotor is increased approximately from 25 degrees, reaches a maximum at about 180 degrees (the rotary angle θ1) and then starts to be decreased. On the other hand, the torque Tr2 of the rotor is increased approximately from 60 degrees and reaches a maximum at about 230 degrees (the rotary angle θ2) and then is decreased smoothly.

Compared with θ1 at which the torque Tr1 of the rotor reaches the maximum, θ2 at which the torque Tr2 of the rotor reaches the maximum is delayed by about 50 degrees. A reason for the delay is whether the coil spring 40 is provided or not, and the difference of the rotation angles is the phase angle θ3.

That is, in a range from 90 degrees to 180 degrees in which Tc is increased intensely, the angular velocity of the eccentric shaft 10 is decreased, which avoids an intense variation of Tc. On the other hand, an opening of the coil spring 40 of the rotor 30 is large, so as to maintain the angular velocity and drive the eccentric shaft 10. Thus, the angle at which the torque Tr reaches the maximum is delayed to about 230 degrees. During this, the opening of the coil spring 40 reaches a maximum so as to store energy.

Subsequently, when the eccentric shaft 10 continues rotating to 360 degrees, Tc is decreased and the coil spring 40 may release the energy. Thus, the angular velocity of the eccentric shaft 10 is increased, and the phase angle θ3 is decreased, in which the phase angle θ3 reaches a minimum at about 25 degrees before compressing again. In above first rotation, the coil spring 40 may extend or retract and the torque Tr of the rotor is smooth, so that the maximum of the torque Tr of the rotor is decreased and the torque curve is relatively flat.

In general, a damping effect is small if θ3 is small and the damping effect is large if θ3 is large. But in a high-velocity operation condition, such as 90 rps, velocities of the stator and the rotor in a same period cannot be maintained if θ3 is too large, which may cause so called an out-of-step phenomenon, thus resulting in an emergency stop of the electric motor.

In order to improve this issue, it is recommended to adopt a design in which a spring characteristic of the torque damping device is nonlinear, and a spring constant is increased along with a size of the phase angle θ3. A transverse axis of FIG. 8 indicates the phase angle θ3 and a longitudinal axis thereof indicates a torque Ts of the coil spring or the spring constant K. Curve A corresponds to a nonlinear spring and Curve B corresponds to a usual linear spring.

It is sure for the linear spring B that Ts or K is increased with respect to an increase of θ3, however, for the nonlinear spring A, an increasing rate increases along with the increase of θ3. Thus, θ3 may be too large, but the caused out-of-step phenomenon may be relieved by using the nonlinear spring. More particularly, the out-of-step phenomenon caused due to a refrigeration overload may be relieved by using the nonlinearity spring. Particularly, it is useful to use the nonlinear spring for the air conditioner with a refrigeration recycle device whose load has a large variation and the electric motor with a variable velocity.

As an alternative of the coil spring 40 used in embodiment 1, for example, a method of fixing a center side of the spiral spring at the eccentric shaft and fixing an outer circumference side of the spiral spring at the rotor. Furthermore, some of detailed design means related to the helical torsion coil spring, the spiral spring and the torsion bar spring shown in embodiment 3 have been disclosed and may be used.

The torque damping device of the present disclosure reduces the torsional vibration, and has following additional effects. These effects may also be applied to the reciprocating compressor of embodiment 2, besides the rotation compressor of embodiment 1, and the torsion bar spring of embodiment 3 has the same effects in use thereof.

1) Noise Reduction

Most of the noise of the electric compressor is caused by the air discharging sound of the compressing chamber. The torque damping device may extend the air discharging time of the compressing chamber and reduce the velocity of the air, so that the air discharging sound can be reduced effectively. Furthermore, the angular velocity of the rotor 30 is stabilized, so as to mitigate a harsh motor sound of 200 to 800 Hz.

2) Starting Performance Improvement of the Compressor

When the operation is stopped, an oil film of the sliding portion may be replaced with a coolant, so that a starting torque of the eccentric shaft is increased, which may cause a problem that the electric motor cannot be started sometimes. However, through the torque damping device, the rotor may be started, so that it is easy to start the eccentric shaft.

3) Reduction of Damages Caused by a Liquid Compression

Since a large amount of coolants are sucked into the compressor, the compressor in operation suffers an emergency stop, or the eccentric shaft or the piston may be damaged. The torque damping device can prevent the compressor from suffering the emergency stop and damage in this condition of an ultra variation of the torque.

4) Reduction of Operation Stops Caused by a Low Voltage.

During a high-torque operation, the compressor may be stopped due to a temporary voltage reduce. The torque damping device can stabilize the rotation torque of the rotor, so as to solve the above problem.

Embodiment 2

The present embodiment is an example in which the present disclosure is used in the reciprocating compressor.

Figure 9:
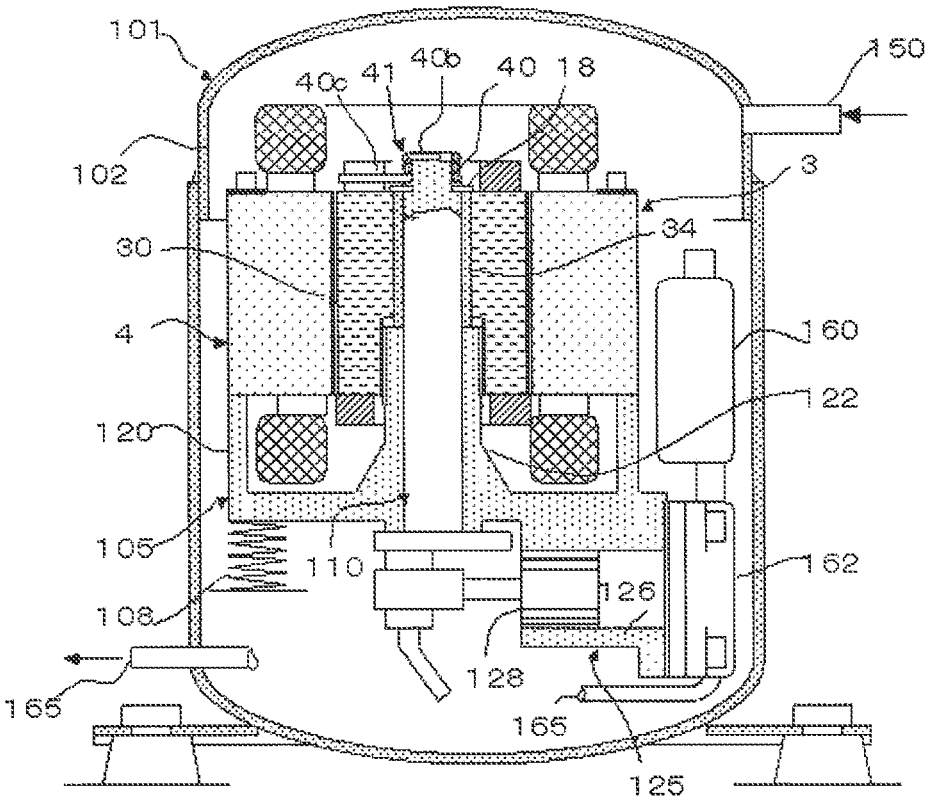
FIG. 9 is related to embodiment 2 of the present disclosure, showing a longitudinal sectional view of a reciprocating compressor.

A casing 102 of the reciprocating compressor 101 shown in FIG. 9 has a compressing mechanism 105 and an electric motor 3 therein. The electric motor 3 includes a stator 4 and a rotor 30, and the compressing mechanism 105 includes a frame 120 configured to fix the stator 4, a cylinder block 125 integral with the frame 120, a compressing chamber 126 and a piston 128 provided in the cylinder block 125, an eccentric shaft 110 configured to drive the piston 128 reciprocatingly, a bearing 122 slidably fitted with the eccentric shaft 110 and a valve cover 162 fixed on the cylinder block 125. The rotor 30 is slidably fitted with the eccentric shall 110, and is connected to the eccentric shaft 110 by a torque damping device 41.

In view of an assembling structure, comparing the reciprocating compressor 101 with the rotation compressor 1, the frame 120 is equivalent to the casing 2 of the rotation compressor 1, However, the compressing mechanism 105 of the reciprocating compressor 101 is supported by three quakeproof springs 108 inside of the casing 102.

In operation of the compressor, a low-pressure air is sucked from a suction tube 150 and flows into the casing 102, and flows into the compressing chamber 126 from a suction silencer 160 through a low-pressure chamber of the valve cover 162. After a high-pressure air compressed by the piston 128 is discharged into a high-pressure chamber of the valve cover 162, the high-pressure air is discharged out to the refrigeration system through an air discharging tube 165. Due to the compression and discharging of the low-pressure air flowing into the compressing chamber 126, a torque Tc of the eccentric shaft 110 is generated.

Figure 10:
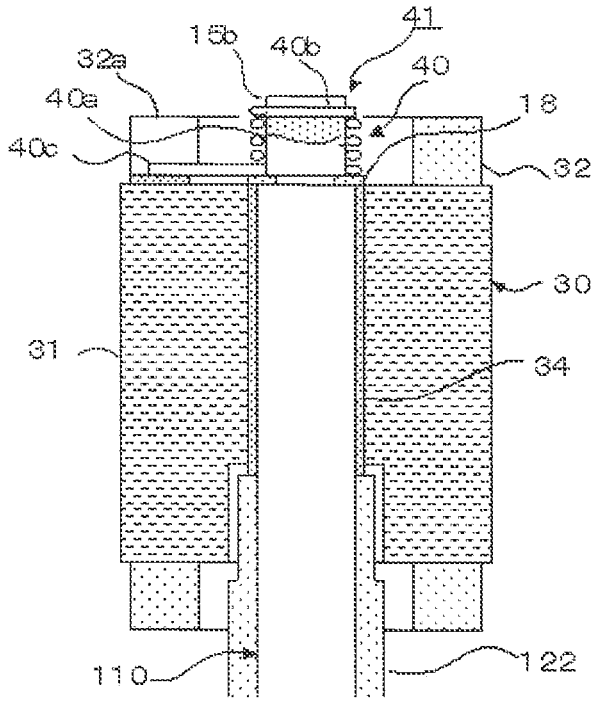
FIG. 10 is related to embodiment 2 of the present disclosure, showing an assembly view of an eccentric shaft, a rotor and a torque damping device.

The torque damping device disposed at the top of the rotor 30 has a same construction with that of embodiment 1, and details of the torque damping device are shown in FIG. 10 which shows a sectional view of the rotor 30. An important difference of the present embodiment from embodiment 1 is that an iron core center tube 34 may be ratable and slidable in the eccentric shaft 110 whose shall diameter is unchanged. Thus, a function and effect of the coil spring 40 are the same with those of embodiment 1.

Figure 11:
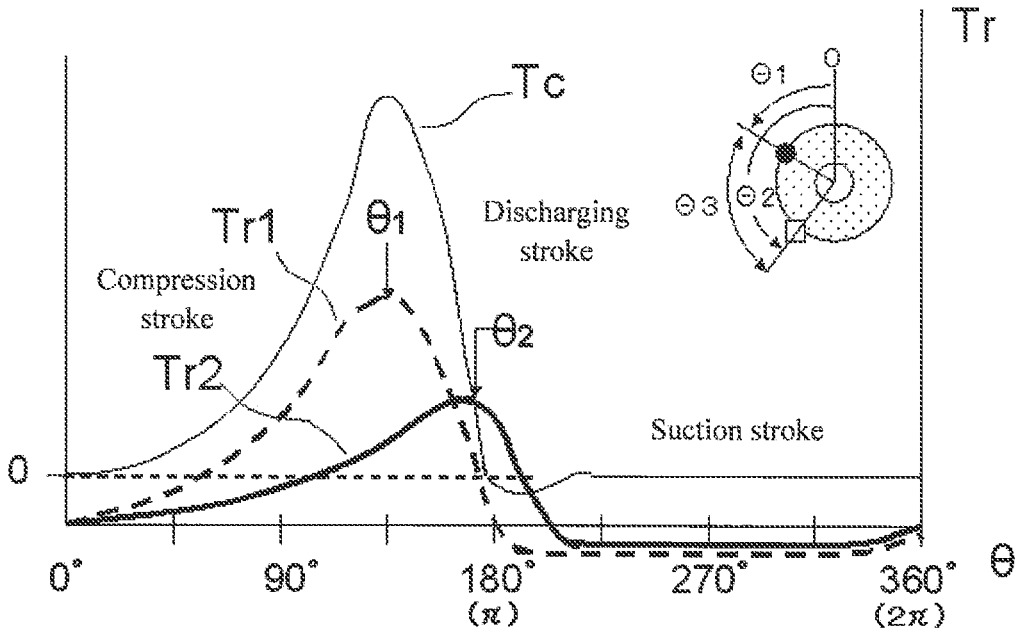
FIG. 11 is related to embodiment 2 of the present disclosure, showing a comparison diagram between the present disclosure and prior technology related to a variation of a torque of an electric motor caused by a shaft torque produced in a compressing chamber.

FIG. 11 is the same with that of embodiment 1 and shows a variation of a shaft torque Tc of the eccentric shaft 110. Tr1 and Tr2 represent variations of torques of a rotor in a conventional reciprocating compressor and the rotor in the reciprocating compressor 101 of embodiment 2 respectively.

The reciprocating compressor compresses air when the eccentric shaft rotates in an angle range from 0 degree to 180 degrees, and sucks in the air when the eccentric shaft rotates in an angle range from 180 degrees to 360 degrees, so that the variation of the shaft torque is much larger compared with the rotation compressor. The shaft torque Tc begins to increase at a bottom dead center (θ=0 degree) of the piston 128, then reaches a maximum at about 135 degrees, subsequently decreases and reaches a minimum at a top dead center of about 180 degrees. The suction stroke is performed in the angle range from 180 degrees to 360 degrees, and thus Tc has the minimum.

The torque Tr1 of the rotor begins to increase during the compression stroke starting from the bottom dead center of 0 degree, reaches a maximum at about 135 degrees and then begins to decrease. On the other hand, the torque Tr2 of the rotor begins to increase at the bottom dead center of 0 degree, but an increasing rate of the torque Tr2 is slower, and the torque Tr2 reaches a maximum at about 160 degrees and then decreases.

Compared with θ1 at which the torque Tr1 of the rotor reaches the maximum, θ2 at which the torque Tr2 of the rotor reaches the maximum is delayed by about 40 degrees. A reason for this is related to whether the coil spring 40 is provided or not and that the phase angle θ3 reaches a maximum. Furthermore, a reason for a difference between the torque value of the rotor and an amplitude of the torque curve of the rotor is related to extension and retraction functions of the coil spring 40, as the same as embodiment 1 described above. That is, as the same as embodiment 1, the angular velocity of the torque of the rotor in the present embodiment is stable and the variation of the torque is small. Thus, the reciprocating compressor 101 can reduce the rotary vibration.

The present disclosure is not limited to an electric motor with a constant velocity, but may be applied in an alternating current (AC) or frequency conversion electric motor with a variable velocity. In addition, a method of combining the quakeproof spring 108 and the torque damping device 41 as required in a conventional kind of electric motor may be used, and the quakeproof spring 108 may also be omitted so as to simplify the design.

In addition, in most of the reciprocating compressors carried in household refrigerators, the electric motor 3 is disposed at a lower side and the compressing chamber 126 is disposed at an upper side, with respect to the frame 120. In such a design, the torque damping devise 41 disclosed herein may also be applied. In the design, an oil pump is disposed under of the eccentric shaft 110, However, the oil pump may also be used in the torque damping device disclosed in the present embodiment.

Embodiment 3

Embodiment 3 uses the torsion bar spring as a torque damping device in the rotation compressor and the reciprocating compressor. Compared with the coil spring, the torsion bar spring has features of small size and light weight, and the torsion bar spring can produce a large torque. The torsion bar spring may be received in the eccentric shaft, so that the space efficiency is high. These features and effects may be further defined by following descriptions.

Figure 12:
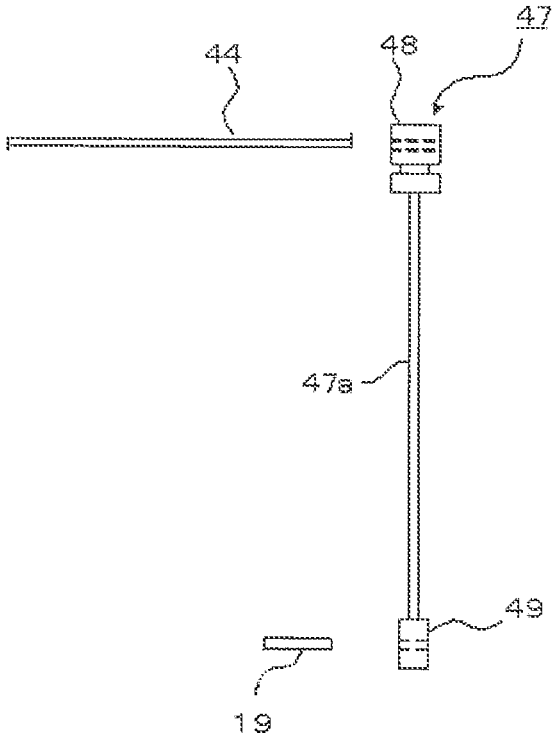
FIG. 12 is related to embodiment 3 of the present disclosure, showing a view of components of a torsion bar spring.
Figure 13:
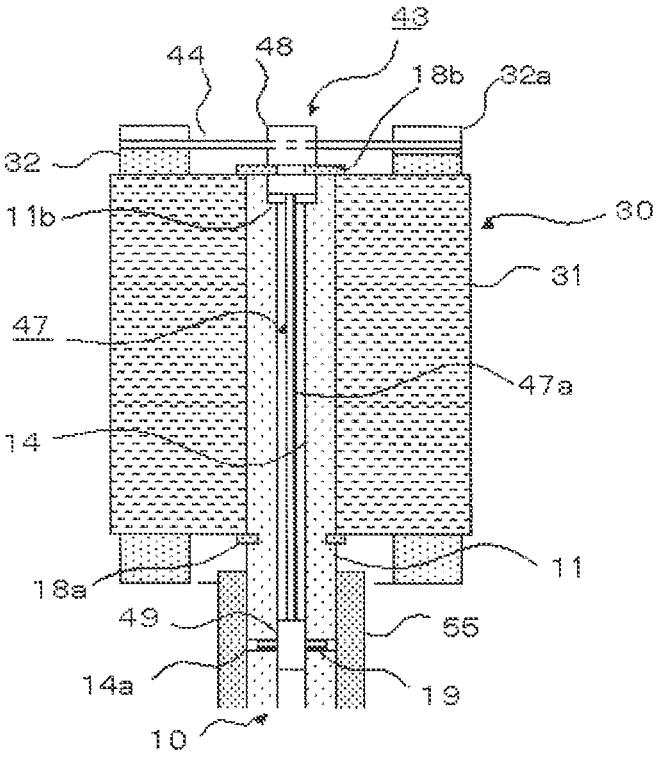
FIG. 13 is related to embodiment 3 of the present disclosure, showing an assembly view of an eccentric shaft, a rotor and a torque bar spring.

FIG. 12 is a view of components of a torsion bar spring 47, a torque bar 44 and a spring pin 19. FIG. 13 shows the torsion bar spring 47 provided in a shaft hole 14 of an eccentric shaft 10.

In FIG. 12, the torsion bar spring 47 includes a torsion shaft 47*a* and an actuation end A48 and an actuation end B49 integrated with two ends of the torsion shaft 47*a*, The actuation end A48 is configured as a cylinder shaft for a common rotation of the eccentric shaft 10 and the rotor 30. The spring pin 19 is a means configured to fix the actuation end B49 in the shaft. The torque bar 44 is a means configured to connect the actuation end A48 to the rotor 30.

In FIG. 13, a main shaft 11 slidably supported by a main bearing 55 has the shaft hole 14. The actuation end B49 may be fixed in the shaft hole 14, and also, a fixing position of the actuation end B49 may be selected optionally, such as in the main bearing 55 (1), or between a top of the main bearing 55 and a bottom of a rotor iron core 31 (2), or in the rotor iron core 31 (3). Thus, a design of the torsion shaft 47*a* has a high free degree.

The fixing position of the actuation end B49 in the embodiment is selected as (1) described above. In the case of a single eccentric shaft 10, the torsion bar spring 47 is inserted into the shaft hole 14 from a top of the shaft hole 14, and then the spring pin 19 is pressed towards the actuation end B49 through a cross hole 14*a* provided in the main shaft 11 and thus the actuation end B49 is fixed in the shaft hole 14. At this time, the actuation end A48 is embedded in a main shaft end hole 11*b* at the same time.

Figure 14:
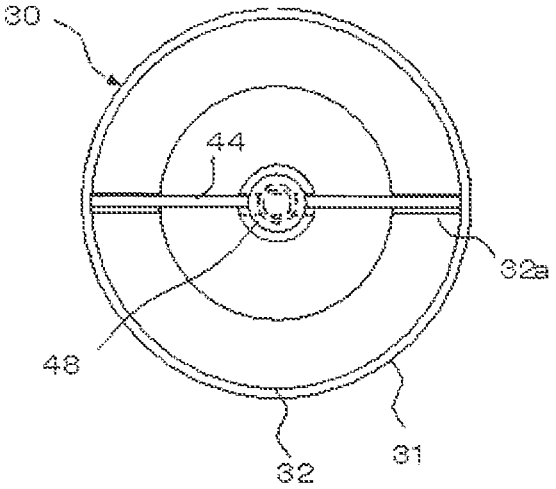
FIG. 14 is related to embodiment 3 of the present disclosure, showing an assembly view of a rotor and a torque bar.

Subsequently, after the main shaft 11 is inserted in from a bearing hole in the bottom of the main bearing 55, a thrust ring 18*a* is fixed in the main shaft 11. Subsequently, the rotor 30 is inserted from the main shaft 11, and then a thrust ring 18*b* is mounted in a groove of the actuation end A48. Moreover, the torque bar 44 is inserted into a cross hole passing through the actuation end A48 and two ends of the torque bar 44 are embedded in an end ring groove 32*a*. An assembling of the main shaft 11, the torsion bar spring 47 and the rotor 30 is implemented by the above process. FIG. 14 shows the torque bar 44 configured to connect the actuation end A48 with the rotor 30.

As same as embodiments 1 and 2, the eccentric shaft 10 and the rotor 30 are connected by the torsion bar spring 47, thus resulting in an implementation of a torque damping device 43. Herein, an inner diameter of the main shaft end hole 11*b* is slidably fitted with an outer diameter of the actuation end A48. The iron core center tube 34 used in embodiments 1 and 2 is omitted in the present embodiment, so that an inner diameter of the rotor iron core 31 may be slidably fitted with the main shaft 11 directly.

With the above design and configuration, the rotation torque of the rotor 30 may be transmitted to the actuation end A48 by the torque bar, so that the torsion bar spring 47 is twisted and the torque of the rotor is transmitted to the eccentric shaft 10. On the contrary, a shaft torque of the eccentric shaft 10 is transmitted to the rotor 30 by the torsion bar spring 47 and the torque bar 44.

In addition, a rotation angle of the torque bar 44 is small within a first rotation. Thus, a gap needs to be provided between the torque bar 44 and the shaft hole 14, so that the torque bar 44 and the shaft hole 14 will not contact with each other. The gap may also be designed to be small, so that the torque bar 44 and the shaft hole 14 are slidably fitted with each other. Both of the two designs may be selected.

Figure 8:
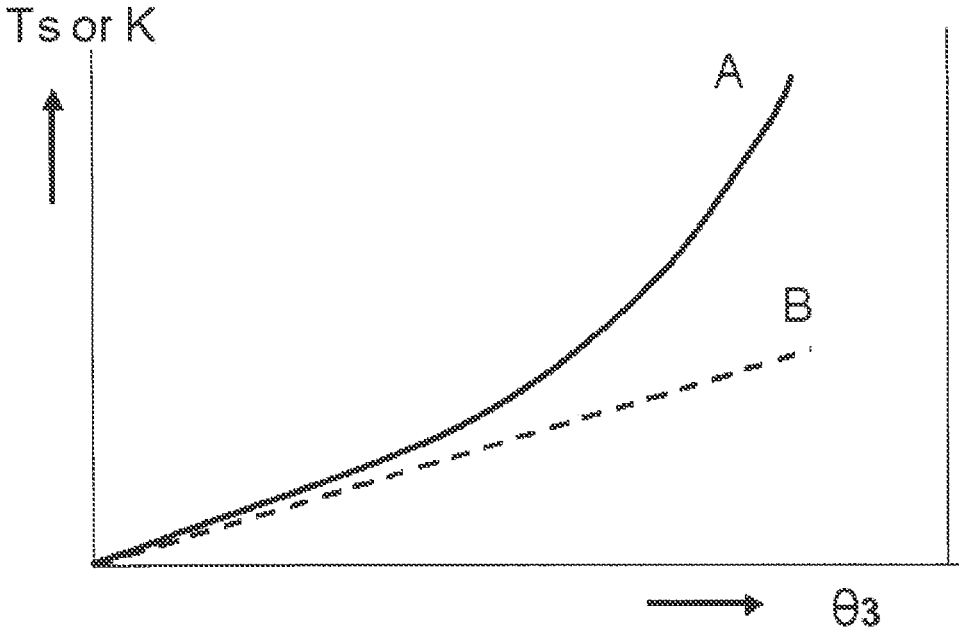
FIG. 8 is related to embodiment 1 of the present disclosure, showing a characteristic concept of a non-liner spring.

The torque damping device 43 having the torsion bar spring 47 has the following characteristics:

(1) The repetition-resistant strong torque is provided, thus resulting in a high reliability;

(2) The free degree of design is very large (as described above);

(3) The members may be disposed within the eccentric shaft 10, so that a miniaturization is realized;

(4) The torsion shaft 47*a* has nonlinear characteristics shown in FIG. 8 so as to conform to a large torque variation of the electric motor;

(5) In general, it has advantages in aspects of design, manufacture and cost, and the stability also is high.

Subsequently, the actuation end A48 designed as the cylinder shaft has following characteristics, due to an aligning and a slidable fitting of the actuation end A48:

(1) The torsion shaft 47*a* is aligned with the shaft hole 14 in a motion;

(2) Due to the twist of the torsion shaft 47*a* in operation, a torque transmission generated between the rotor 30 and the eccentric shaft 10 is accurate;

(3) Advantages are provided in the combination stability and assembly of the torque bar 44 and the torsion rod spring 47.

Figure 15:
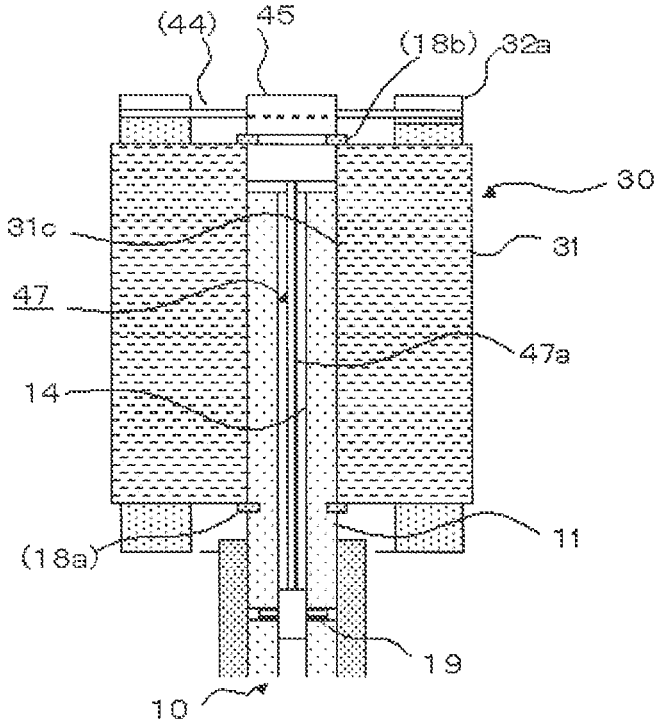
FIG. 15 is related to embodiment 3 of the present disclosure, showing an application design view related to an assembly of a torque bar spring and a rotor.

FIG. 15 shows a design in which the actuation end A48 is not used, and an actuation end C45 is used and slidably fitted with an inner diameter 31*c* of the rotor iron core 31. An outer diameter of the actuation end C45 is approximately equal to an outer diameter of the main shaft 11, so that the actuation end C45 can slide. In addition, in such design, the actuation end C 45 may be pressed in and fixed at the inner diameter of the rotor iron core 31. In such alternative design, compared with the design in which the actuation end A48 is used, any one or all of the torque bar 44, the thrust ring 18*a* and the thrust ring 18*b* may be omitted.

The helical torsion coil spring 40 disclosed embodiments 1 and 2, compared with the torsion bar spring 47 in the present embodiment, may be applied in the reciprocating compressor and the rotation compressing with small operation torques. On other hand, because of the large free degree and the high reliability, the torsion bar spring 47 may be used in a wide range from a small-size compressor to a large-size commercial compressor.

In the design of the torsion rod spring 47, a shaft section of the torsion shaft 47*a* usually has a circular shape, but also may have a polygonal shape and a hollow tube shape. The method of fixing the actuation end A48 and the actuation end B49 to the torsion shaft 47*a* may be an integrated manufacturing method, such as connecting the two actuation ends to the torsion shaft 47*a* by cold forging, or abolishing the cylinder shaft of the actuation end described above and bending the torsion shaft 47*a* to a L shape.

Embodiment 4

Embodiment 4 is a method of mounting the rotor-side actuation end 40*c* of the helical torsion coil spring 40 or the actuation end A48 of the torsion rod spring 47 at the rotor 30. There is a plurality of methods according to a subject matter of the present disclosure, and the present embodiment is one example thereof.

Figure 16:
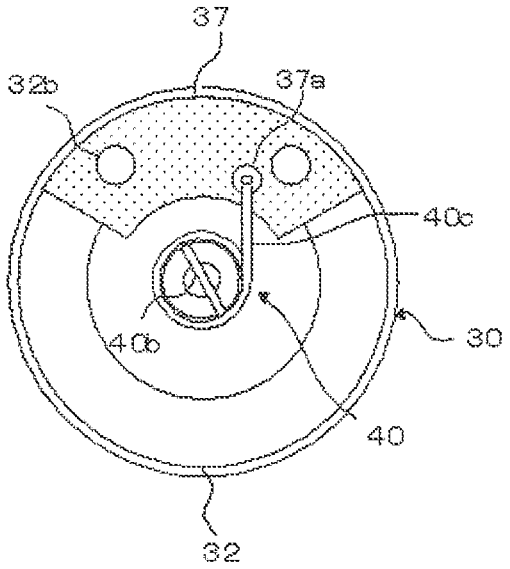
FIG. 16 is related to embodiment 4 of the present disclosure, showing an assembly view of a helical torsion coil spring and a rotor.

In FIG. 16, an end plate 37 is fixed by a rivet 32*b* provided in an end ring 32. The rotor-side actuation end 40*c* is mounted to an end plate hole 37*a*. In addition, the end plate 37 may be used as a balancing block.

Figure 17:
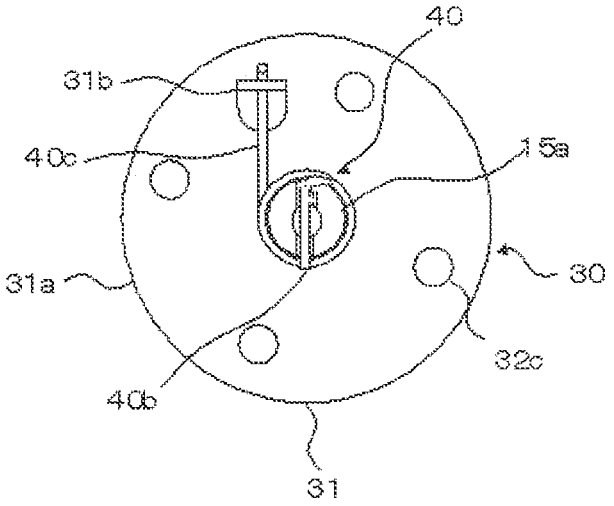
FIG. 17 is related to embodiment 4 of the present disclosure, showing an assembly view of a helical torsion coil spring and a rotor iron core.

FIG. 17 shows a design in which the rotor-side actuation end 40*c* is mounted at a rotor of a direct current (DC) frequency conversion electric motor without the end ring. An iron core end plate 31*a* of the rotor iron core 31 may be provided with a hook 31*b* by press molding. In addition, a circular plate disposed on the iron core end plate 31*a* may also be provided with the hook 31*b*.

Figure 18:
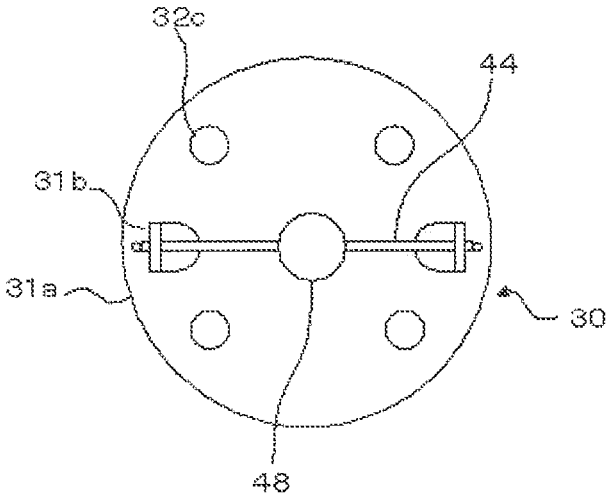
FIG. 18 is related to embodiment 4 of the present disclosure, showing an assembly view of a torque bar and a rotor iron core.

FIG. 18 shows an application case of the torsion rod spring 47. The torque rod 44 is fixed by the two hooks 31*b* facing towards the iron core end plate 31*a*. In addition, if the rotor has the end ring as shown in FIG. 16, the end plate 37 is a circular plate, and the torque bar 44 may be fixed on the end plate 37.

The electric compressor of the present disclosure is applied, targeting at the rotary compressor such as the rotation compressor and the scroll compressor, and the reciprocating compressor. In these compressors, the electric compressor of the present disclosure also may be applied to a horizontal compressor with an eccentric shaft disposed horizontally. In addition, the present disclosure may be applied to an induction electric motor as well as a frequency conversion electric motor. These compressors may be carried in equipment such as an air conditioner, a cooling and refrigerating device, a water heater, a vehicle refrigeration conditioner and a refrigerator.

In conclusion, the problem to be solved by the present disclosure is described as follows: the eccentric shaft generates a torque fluctuation due to the air compression of the compressing chamber, the torque fluctuation leads to a variation of the angular velocity of the rotor, and thus the compressor has a rotary vibration.

In order to solve the problem described above, in the present disclosure, the rotor is not fixed to the eccentric shaft directly, but the two components are only slidably fitted to each other in a rotation direction and connected to each other by a torque damper, which is characterized in that the variation of the shaft torque is prevented from affecting the angular velocity the rotor directly. In addition, the present disclosure may be applied in the induction-electric-motor compressor with a high penetration, and may also be applied in DC and AC frequency conversion electric motors.

A specific technical means used in the present disclosure is that the torque damping device 41 including the helical torsion coil spring 40 is disposed in the spring mounting shaft 15*a* of the eccentric shaft 10. The actuation ends at two sides of the helical torsion coil spring 40 are connected to the eccentric shaft 10 and the rotor 30 rotatably and slidably fitted with the eccentric shaft 10 respectively. The eccentric shaft 10 may change the angular velocity according to increase and decrease of the shaft torque, but the torque damping device may stabilize the angular velocity of the rotor 30.

The beneficial effects of the present disclosure are shown as follows:

(1) The present disclosure may be used in most electric motors with the objective of reducing vibration;
(2) The construction is simple and has a little effect on the design and the manufacture;
(3) The compressor control and system do not need to be changed.
(4) The efficiency of the electric motor is not decreased in all operation conditions.
(5) Not only the vibration can be reduced, but also the starting performance of the compressor and the reliability can be improved, and also the noise can be reduced.

In the present disclosure, unless specified or limited otherwise, a structure in which a first feature is "on" or "below" a second feature may include an embodiment in which the first feature is in direct contact with the second feature, and may also include an embodiment in which the first feature and the second feature are not in direct contact with each other, but are contacted via an additional feature formed therebetween. Furthermore, a first feature "on," "above," or "on top of" a second feature may include an embodiment in which the first feature is right or obliquely "on," "above," or "on top of" the second feature, or just means that the first feature is at a height higher than that of the second feature; while a first feature "below," "under," or "on bottom of" a second feature may include an embodiment in which the first feature is right or obliquely "below," "under," or "on bottom of" the second feature, or just means that the first feature is at a height lower than that of the second feature.

Reference throughout this specification to "an embodiment," "some embodiments," "one embodiment," "a specific example," or "some examples," means that a particular feature, structure, material, or characteristic described in connection with the embodiment or example is included in at least one embodiment or example of the present disclosure. Thus, the appearances of the phrases such as "in some embodiments," "in one embodiment", "in an embodiment", "in another example," "in an example," "in a specific example," or "in some examples," in various places throughout this specification are not necessarily referring to the same embodiment or example of the present disclosure. Furthermore, the particular features, structures, materials, or characteristics may be combined in any suitable manner in one or more embodiments or examples.

Although explanatory embodiments have been shown and described, it would be appreciated by those skilled in the art that the above embodiments cannot be construed to limit the present disclosure, and changes, alternatives, and modifications can be made in the embodiments without departing from spirit, principles and scope of the present disclosure.

What is claimed is:

1. An electric compressor comprising:
a compressing assembly comprising:
a cylinder defining a compressing chamber; and
an eccentric shaft configured to be rotated within the compressing chamber to perform a compression within the compressing chamber,
wherein the eccentric shaft defines a shaft hole extending along a longitudinal axis;
an electric motor comprising:
a stator;
a rotor configured to be rotated by the stator, wherein the rotor defines a center hole extending along the longitudinal axis,
wherein the center hole of the rotor extends between a first end of the rotor that is arranged farther from the cylinder of the compressing assembly and a second end of the rotor that is arranged closer to the cylinder of the compressing assembly, and
wherein a part of the eccentric shaft is configured to be arranged within the center hole of the rotor to rotate about and slide along the center hole; and
an end ring formed from the rotor or an end plate fixedly arranged on the first end of the rotor; and
a torsion bar spring comprising:
a torsion shaft arranged within the shaft hole to be separated from the eccentric shaft by a first gap;
a first actuation end integrated with a first end of the torsion shaft;
a second actuation end integrated with a second end of the torsion shaft;
a torque bar configured to connect the first actuation end to the end ring or the end plate and to be spaced apart from the shaft hole by a second gap; and
a spring pin configured to connect the second actuation end to the eccentric shaft,
wherein the torsion bar spring is configured to transmit rotation torque of the rotor to rotate the eccentric shaft via the end ring or the end plate, the torque bar separated from the shaft hole by the second gap, the first actuation end, the torsion shaft, the second actuation end and the spring pin.

2. The electric compressor according to claim 1,
wherein a longitudinal axis of the torque bar perpendicularly intersects a longitudinal axis of the torsion shaft.

3. The electric compressor according to claim 1,
wherein a difference between a rotation angle of the eccentric shaft and a rotation angle of the rotor is a phase angle, and
wherein the torsion bar spring is configured as a non-linear spring having a spring constant which increases with an increase of the phase angle.

4. The electric compressor according to claim 1,
wherein the compressing assembly comprises:
a bearing configured to support the eccentric shaft in a slidable fitting manner,
wherein the portion of the eccentric shaft to which the second actuation end is connected is positioned within a range from the first actuation end to and including a position where the bearing supports the eccentric shaft.

5. A refrigeration device comprising:
an electric compressor comprising:
a compressing assembly comprising:
a cylinder defining a compressing chamber; and
an eccentric shaft configured to be rotated within the compressing chamber to perform a compression within the compressing chamber,
wherein the eccentric shaft defines a shaft hole extending along a longitudinal axis;
an electric motor comprising:
a stator;
a rotor configured to be rotated by the stator, wherein the rotor defines a center hole extending along the longitudinal axis,
wherein the center hole of the rotor extends between a first end of the rotor that is arranged farther from the cylinder of the compressing assembly and a second end of the rotor that is arranged closer to the cylinder of the compressing assembly, and
wherein a part of the eccentric shaft is configured to be arranged within the center hole of the rotor to rotate about and slide along the center hole; and
an end ring formed from the rotor or an end plate fixedly arranged on the first end of the rotor; and
a torsion bar spring comprising:
a torsion shaft arranged within the shaft hole to be separated from the eccentric shaft by a first gap;
a first actuation end integrated with a first end of the torsion shaft;
a second actuation end integrated with a second end of the torsion shaft;
a torque bar configured to connect the first actuation end to the end ring or the end plate and to be spaced apart from the shaft hole by a second gap; and
a spring pin configured to connect the second actuation end to the eccentric shaft,
wherein the torsion bar spring is configured to transmit rotation torque of the rotor to rotate the eccentric shaft via the end ring or the end plate, the torque bar separated from the shaft hole by the second gap, the first actuation end, the torsion shaft, the second actuation end and the spring pin;
a plurality of heat-exchangers configured to be connected to the compressing chamber of the compressing assembly to deliver low-pressure air to the compressing chamber and to receive high-pressure air compressed by rotation of the eccentric shaft.

6. The refrigeration device according to claim 5,
wherein a longitudinal axis of the torque bar perpendicularly intersects a longitudinal axis of the torsion shaft.

7. The refrigeration device according to claim 5,
wherein a difference between a rotation angle of the eccentric shaft and a rotation angle of the rotor is a phase angle, and wherein the torsion bar spring is configured as a non-linear spring having a spring constant which increases with an increase of the phase angle.

8. The refrigeration device according to claim 5, wherein the compressing assembly comprises:

a bearing configured to support the eccentric shaft in a slidable fitting manner, wherein the portion of the eccentric shaft to which the second actuation end is connected is positioned within a range from the first actuation end to and including a position where the bearing supports the eccentric shaft.

* * * * *